US007712620B2

(12) United States Patent
Nemoto et al.

(10) Patent No.: US 7,712,620 B2
(45) Date of Patent: May 11, 2010

(54) PACKAGING CONTAINER WITH FINGER RECEIVING PORTION

(75) Inventors: Yoshinori Nemoto, Yokohama (JP); Masaki Miura, Yokohama (JP); Noriaki Ushio, Yokohama (JP)

(73) Assignee: Tokyo Seikan Kaisha Ltd., Tokyo (JP)

( * ) Notice: Subject to any disclaimer, the term of this patent is extended or adjusted under 35 U.S.C. 154(b) by 411 days.

(21) Appl. No.: 11/793,785

(22) PCT Filed: Feb. 14, 2006

(86) PCT No.: PCT/JP2006/302484

§ 371 (c)(1),
(2), (4) Date: Jun. 21, 2007

(87) PCT Pub. No.: WO2006/087998

PCT Pub. Date: Aug. 24, 2006

(65) Prior Publication Data

US 2008/0149588 A1 Jun. 26, 2008

(30) Foreign Application Priority Data

Feb. 18, 2005 (JP) ..... 2005-042970

(51) Int. Cl.
*B65D 23/10* (2006.01)
*B65D 1/02* (2006.01)
*B65D 1/46* (2006.01)

(52) U.S. Cl. ..... 215/384; 215/398; 220/755; 220/771

(58) Field of Classification Search ..... 215/379, 215/384, 398; 220/672, 675, 755, 771
See application file for complete search history.

(56) References Cited

U.S. PATENT DOCUMENTS

| | | | | |
|---|---|---|---|---|
| 5,381,910 | A * | 1/1995 | Sugiura et al. | 215/398 |
| 6,749,075 | B2 * | 6/2004 | Bourque et al. | 215/384 |
| 2006/0054587 | A1 * | 3/2006 | Oguchi et al. | 215/381 |

FOREIGN PATENT DOCUMENTS

| | | | |
|---|---|---|---|
| JP | 08-230856 | A | 9/1996 |
| JP | 2002-145233 | A | 5/2002 |
| JP | 2002-154517 | A | 5/2002 |
| JP | 2004-250063 | A | 9/2004 |
| JP | 2004-292039 | A | 10/2004 |

* cited by examiner

*Primary Examiner*—Sue A Weaver
(74) *Attorney, Agent, or Firm*—Manabu Kanesaka

(57) ABSTRACT

In a bottle 1 having a waist groove 61 and a grasping recess 63 nearly in the center of the height direction of a body portion 4 for imparting the sloped surface of a waist portion with necessary strength and restoring capability so that the denting and deformation of the sloped surface of the waist portion are prevented and for forming an easily graspable container even if it is a thin-wall container of which the weight has been decreased, a finger receiving recess 62 having the form of a convex curved surface toward an inside of the container is formed in a region including a container bottom portion side connecting face 61*c* of the waist groove 61.

13 Claims, 4 Drawing Sheets

PACKAGING CONTAINER WITH FINGER RECEIVING PORTION

FIELD OF THE INVENTION

This invention relates to a container having a waist portion nearly in the center along the height direction of its body portion and particularly to a thin-wall plastic bottle having a light weight and having high restoring capability.

TECHNICAL BACKGROUND

Bottles made of plastic such as PET bottles are easily produced by molding and suitable for mass production, and they have excellent properties such as high mechanical strength and a light weight, so that they are used as containers for filling various liquids therein in wide fields.

In particular, large quantities of them are used as beverage containers for various beverages, mineral water, and the like, in recent years.

With regard to the volume of the bottle, many kinds of bottles are available as will suit market demands. For example, containers having a volume of about 2,000 ml are used as large-volume containers. Concerning the form of the containers, there are conventionally employed containers having a transverse-sectional form of a circle or containers having a transverse-sectional form of a rectangle or square formed by taking account of storability thereof in a refrigerator.

In a large-volume bottle, a waist portion having a form constricted mainly along the circumferential direction is formed nearly in the center in the height direction of the body portion for imparting the body portion with necessary strength. The waist portion not only works as a reinforcing portion but also works as a grasping portion which is caught with fingers when the bottle is held with one hand, so that it improves the bottle in easiness of handling.

Meanwhile, in recent years, the wall thickness of bottles is decreasing with the tendency to decrease the weight of bottles together with natural resources saving, so that the strength of bottles is declining as a whole. In thin-wall bottles of which the weight is decreased, it is required to form side beads, etc., on the body portion to impart the bottle with necessary strength and restoring strength so that the denting and distortion of the bottle are prevented (for example, see Patent Document 1).

Patent Document 1 JP-A-2004-250063

DISCLOSURE OF THE INVENTION

Problems to be Solved by the Invention

However, it has been found that even if side beads, etc., are formed on the body portion, a bottle of which the weight is decreased to a certain extent has a dent or deformation in the waist portion, due to a collision of one bottle with another during their production or transportation or when the bottle is grasped with the hand or displayed at the store. The above dent and deformation mostly occur in a sloped surface (including a circular arc surface) of the waist groove portion, and they cannot be prevented even if the position of side beads to be formed on the body portion is changed.

Patent Document 1 discloses a container having a grasping portion formed on the waist portion.

However, when the above grasping portion alone is provided, a force is concentrated on two fingers that are the thumb and the index or middle finger which hold the grasping portion between these two fingers, and if the weight of the container is decreased to the maximum, the waist portion of the container undergoes a deformation and buckling when the container is taken up and a liquid contained therein is poured, so that the container is difficult to handle. Further, when a force is exerted on the sloped surface of the grasping portion or the sloped surface of the waist portion with the medicinal finger or middle finger for dispersing the force of the two fingers away, the sloped surface undergoes a deformation or buckling due to insufficient stiffness. When the buckling occurs, it is difficult to restore the original shape of the slope.

This invention has been made under the above circumstances, and the object of the invention is to provide a container that is a thin-wall container whose weight is decreased, that is imparted with necessary strength and restoring capability in particular in the sloped surface of the waist portion and its vicinity for preventing a dent and deformation in the vicinity of the sloped surface of the waist portion and that is far easier to handle.

Means to Solve the Problems

The packaging container of the invention for achieving the above object is a container having a mouth portion, a body portion and a bottom portion and having a constitution in which a waist groove having a container mouth portion side connecting face, a groove bottom surface and a container bottom portion side connecting face is formed nearly in the center in the height direction of said body portion, at least one pair of mutually opposing grasping recesses are formed on said waist groove, and at least one finger receiving recess is formed in a region including at least the container bottom portion side connecting face of said waist groove, the finger receiving recess being positioned on the side of said bottom portion relative to said waist groove and having the form of a convex curved surface toward an inside of the container.

According to the packaging container of the invention having the above constitution, when the holding hand applies a force for holding the container, other one finger such as the middle or medicinal finger other than the two fingers that are the thumb and the index or middle finger to hold the grasping recess is received in the finger receiving recess while getting the other one finger close to the finger holding the grasping recess, whereby a force can be exerted on the other one finger, and the finger can be received as if the inner surface of the finger were wrapped in the finger receiving recess form which is a convex curved surface toward an inside of the container.

Further, the effect of an edge line forming the edge of the finger receiving recess as an essential part can enhance the stiffness of the container bottom portion side connecting face of the waist groove (in other words, a surface connecting the waist bottom surface of the waist groove and the body portion in the direction of the container bottom side relative to the waist groove, and for example, it is a sloped surface of the waist portion) and the restoring strength when deformation by buckling takes place. Further, preferably two finger receiving recesses are provided further preferably in opposing positions, and in this case, when a liquid contained is poured with both hands, the thumb of the other hand holding the grasping recess can be effectively received.

Further, the packaging container of this invention may have a constitution in which said grasping recess has a container mouth portion side connecting face and a container bottom portion side connecting face which are respectively connected to the bottom surface of said grasping recess and said finger receiving recess is formed in a region including the container bottom portion side connecting face of said grasping recess.

When this constitution is employed, not only the effect of the present invention is exhibited, but the container bottom portion side connecting face of the grasping recess is reinforced. In addition to this, an edge line formed in the container bottom portion side connecting face of the grasping recess and an edge line of the finger receiving recess are connected to each other, so that the container bottom portion side connecting face of the waist groove is more reinforced.

The packaging container of the present invention may have a constitution in which the container is of an angular type having a mouth portion, a body portion and a bottom portion, waist grooves each having a container mouth portion side connecting face, a groove bottom surface and a container bottom portion side connecting face are formed nearly in the center in the height direction of at least one pair of mutually opposing surfaces of said body portion, at least one pair of mutually opposing grasping recesses are formed on said waist grooves, and at least one finger receiving recess is formed in a region including at least the container bottom portion side connecting face of said waist groove, the finger receiving recess being positioned on the side of said bottom portion relative to said waist groove and having the form of a convex curved surface toward an inside of the container. In this case, there may be also employed a constitution in which said grasping recess has a container mouth portion side connecting surface and a container bottom portion side connecting face which are respectively connected to the bottom surface of said grasping recess, and said finger receiving recess is formed in a region including the container bottom portion side connecting face of said grasping recess.

In the case of an angular type container, the waist grooves and grasping recesses of the waist portion are formed on at least one pair of opposing surfaces, and the finger receiving recess is provided in one place in a region including the container bottom portion side connecting face of the waist groove. Such a container is graspable and can exhibit the above effects of the finger receiving property of the finger receiving recess, stiffness and restoring capability.

The packaging container of this invention may have a constitution in which the container bottom side connecting face of said grasping recess is constituted of two or more surfaces that are joined together in the height direction.

When the above constitution is employed, not only the effect of the present invention is fully exhibited, but the container bottom portion side connecting face of the grasping recess can be reinforced by an increase in the number of edge lines of the container bottom portion side connecting face of the grasping recess.

Further, the packaging container of this invention may have a constitution in which the surface connected to said finger receiving recess out of the two or more surfaces constituting the container bottom portion side connecting face of said grasping recess is an arch-like surface in the form of a band along the upper edge of said finger receiving recess. In this case, preferably, the tilt angle of the above arch-like surface to the horizontal surface is 30 to 65°.

When the above constitution is employed, two edge lines are formed in contiguity with each other along the upper edge of the finger receiving recess, so that the effect on the reinforcement of the container bottom portion side connecting face of the grasping recess can be further improved, and that the deformation and buckling of the container bottom portion side connecting face of the grasping recess can be effectively avoided. Further, the finger fitting condition is improved, so that the container is more improved in graspability.

The packaging container of this invention may have a constitution in which the surface that is connected to the bottom surface of said grasping recess, out of the two or more surfaces constituting the container bottom portion side connecting face of said grasping recess, has a longitudinal sectional form of a convex curved surface toward an outside of the container.

When the above constitution is employed, the stiffness and restoring capability against the pressing force that is exerted on the upper connecting face by the index finger or middle finger that is let in the grasping recess are enhanced, and the deformation and buckling of the container bottom portion side connecting face of the grasping recess can be more effectively avoided. In particular, the surface that is connected to the bottom surface of the above grasping recess is formed in a pommel horse-like form, whereby said surface can be more improved in stiffness and restoring capability while improving the touch feeling when the container is grasped.

In the packaging container of this invention, preferably, the above finger receiving recess has a height of 5 mm to 30 mm and the longitudinal section of the above finger receiving recess in the center in the width direction has the form of an arch-like curved surface. Further, the above finger receiving recess preferably has a lateral width of 20 mm to 50 mm.

When the above constitution is employed, not only the effect of the present invention is fully exhibited, but the finger that is received in the finger receiving recess is well received or caught while securing the strength of curved surface of the finger receiving recess.

The packaging container of this invention may also have a constitution in which a side bead is provided in at least one place above or below the above grasping recess.

When the above constitution is employed, the side bead provided above or below the grasping recess interrupts transmission of a pressing force that is exerted on the grasping recess when the container is grasped by letting the finger in the grasping recess, so that the denting and deformation of surface of the body portion can be effectively avoided.

The packaging container of this invention may have a constitution in which discontinuous or continuous steps along the circumferential direction are formed on that portion of the above body portion on the above mouth portion side or the above body portion on the above bottom portion side which has relatively a smaller wall thickness than other portion.

Since the waist groove and the grasping recess are formed nearly in the center in the height direction, the mouth portion side or bottom portion side of the body portion tends to relatively have a smaller wall thickness, and when the above constitution is employed, a sink mark in a portion that is liable to relatively have a smaller thickness on the mouth portion side or bottom portion side of the body portion can be prevented even if the packaging container of this invention is liable to have problems of a sink mark and the like.

EFFECT OF THE INVENTION

As described above, according to this invention, the container bottom portion side connecting face of the waist groove (sloped surface of waist portion) is imparted with necessary strength and restoring capability by means of the finger receiving recess that is convex toward an inside of the container and that is formed in a region including the container bottom portion side connecting face of the waist groove. In a thin-wall container of which the weight is decreased, therefore, the grasping force applied to the grasping portion can be reduced by dispersing it to the finger receiving recess, and the container is improved in easiness of handling, and the strength and restoring capability of the container bottom portion side connecting face of the waist groove can be increased.

EXPLANATION OF SYMBOLS

Figure 1:
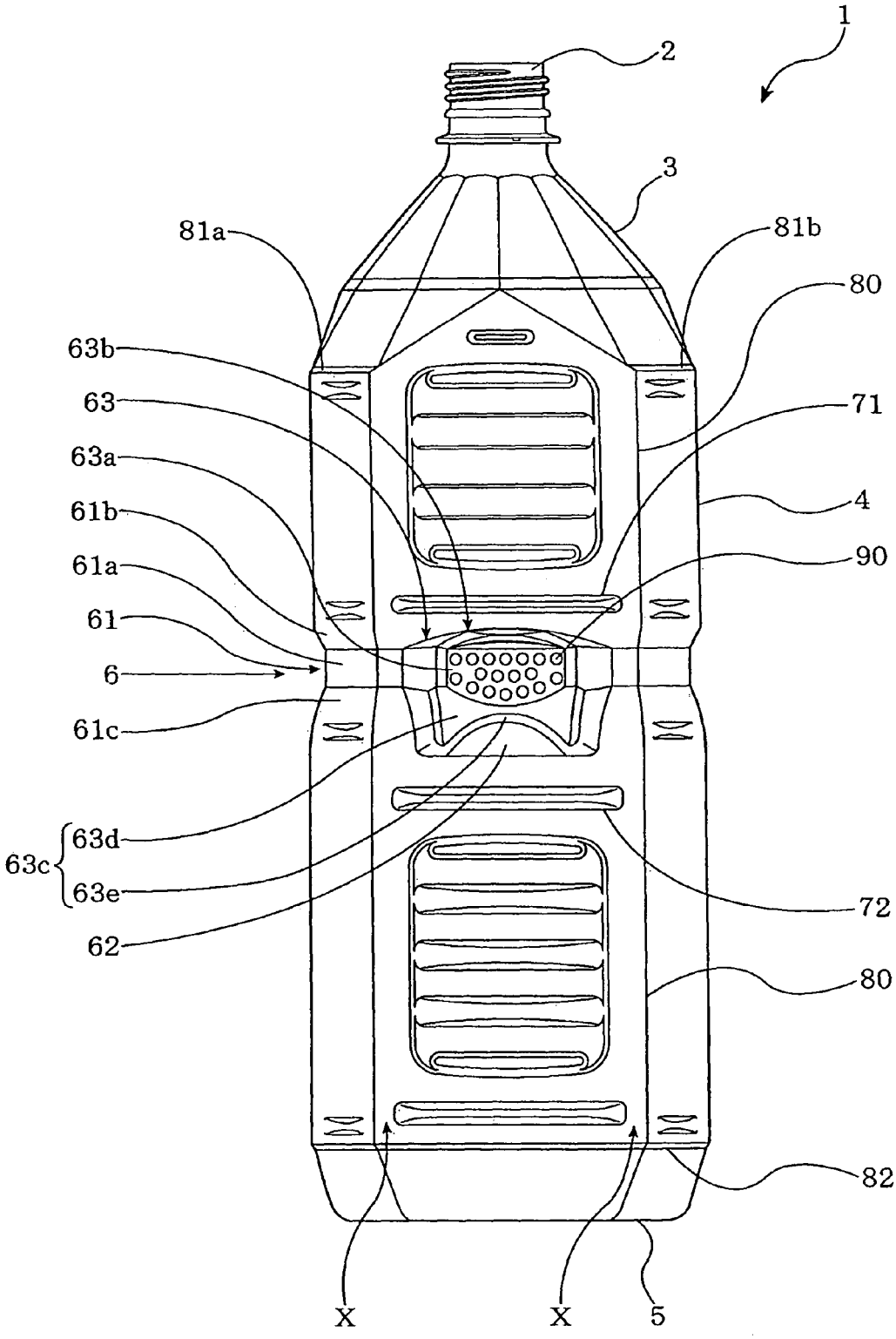
FIG. 1 is a front view outlining an embodiment of the packaging container according to the invention.

1 Bottle
2 Mouth portion
3 Shoulder portion
4 Body portion
5 Bottom portion
6 Waist portion
61 Waist groove
61*a* Groove bottom surface
61*b* Container mouth portion side connecting face
61*c* Container bottom portion side connecting face
62 Finger receiving recess
63 Grasping recess
63*a* Bottom surface
63*b* Connecting face on container mouth portion
63*c* Connecting face on container bottom portion
63*d* Upper connecting face
63*e* Lower connecting face
71, 72 Side bead
81*a*, 81*b*, 82 Step portion

PREFERRED EMBODIMENT OF THE INVENTION

As an example of the packaging container of the invention, an embodiment in which the invention is applied to a bottle made of plastic will be explained below with reference to drawings.

Figure 2:
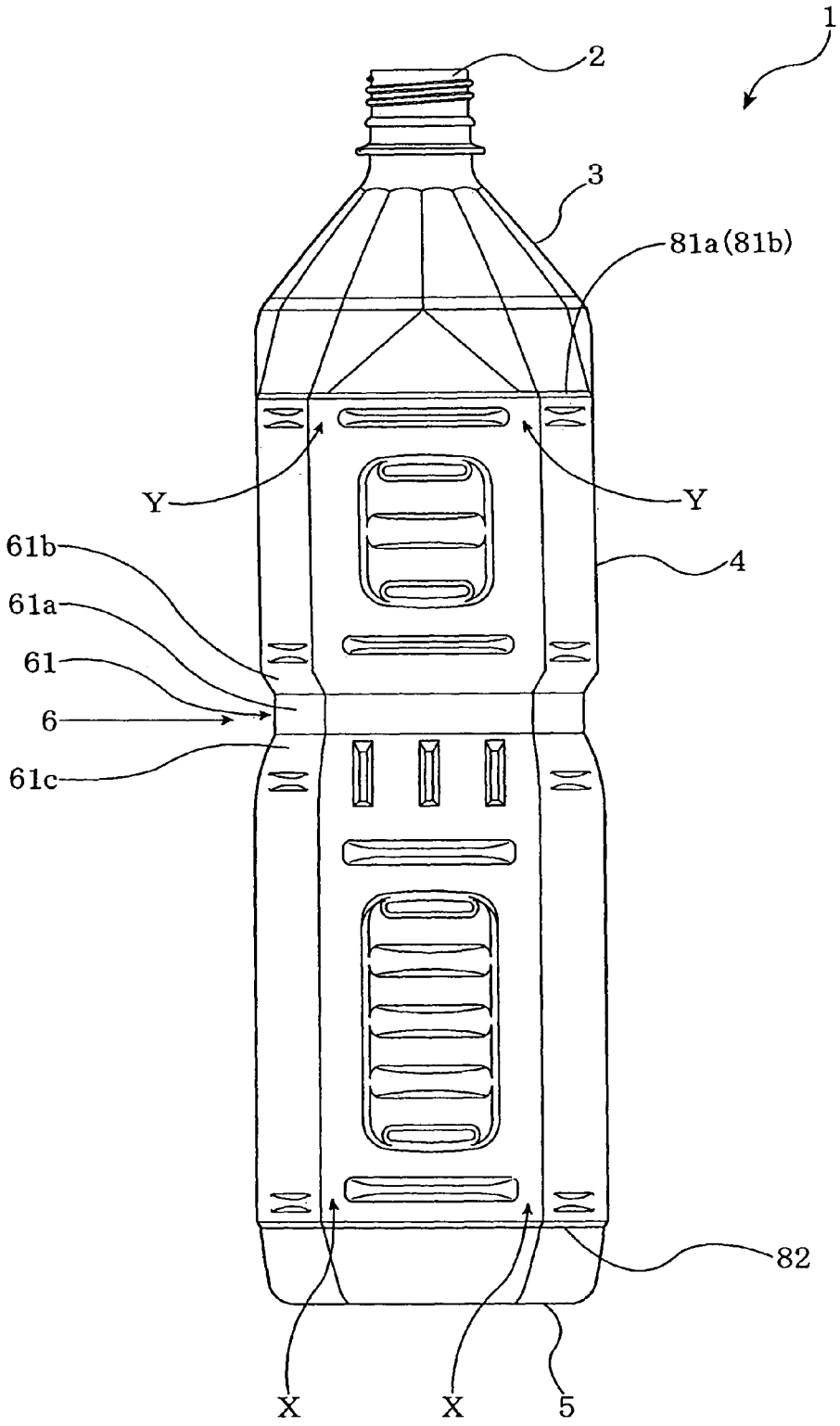
FIG. 2 is a side view outlining the embodiment of the packaging container according to the invention.
Figure 3A:
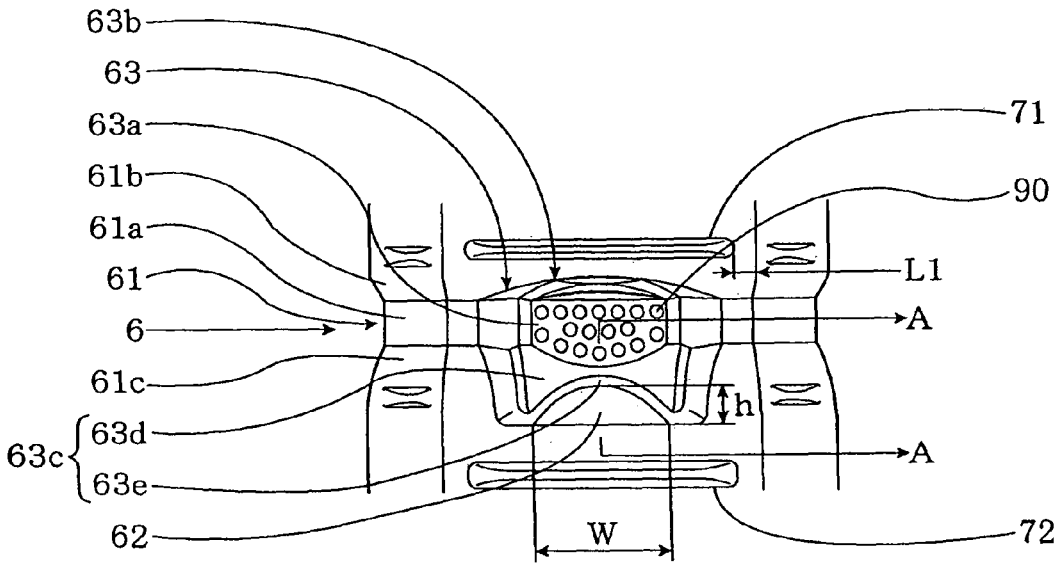
FIG. 3(*a*) is an enlarged view showing vicinities of a waist portion in the embodiment of the packaging container according to the invention, and FIG. 3(*b*) is a supplemental explanatory thereof.
Figure 3B:
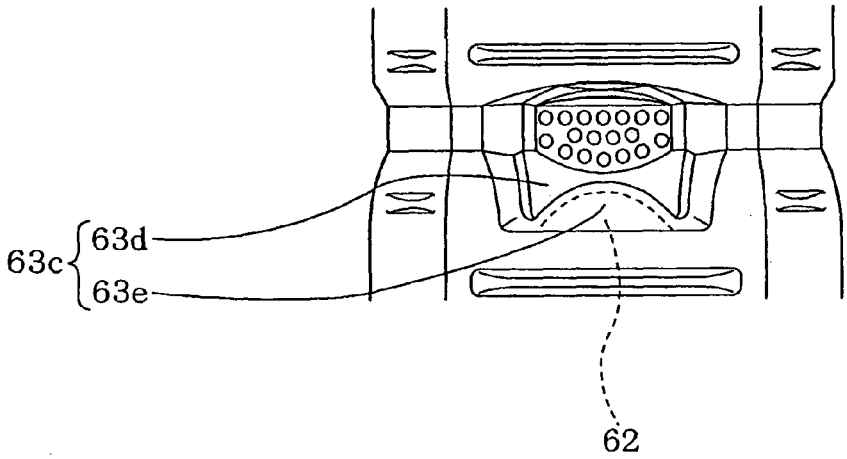
Figure 4:
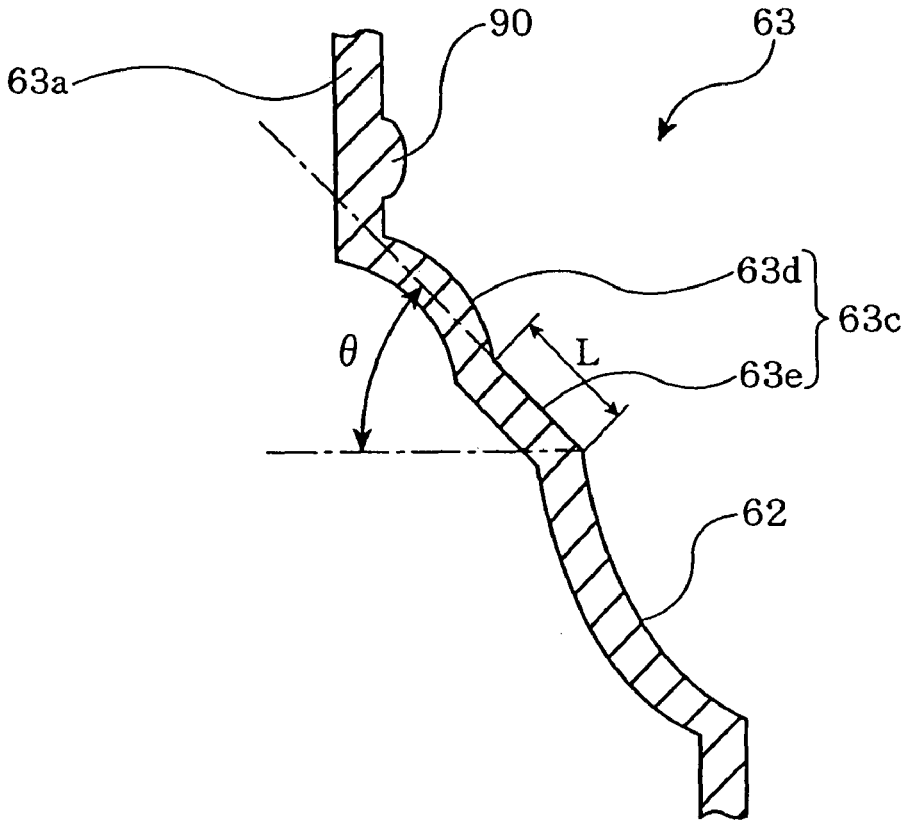
FIG. 4 is a cross-sectional view taken along A-A in FIG. 3(*a*).

In this connection, FIG. 1 is a front view of the bottle according to this embodiment. FIG. 2 is a side view of the bottle according to this embodiment. FIG. 3 is an enlarged view showing vicinities of a waist portion of the bottle according to this embodiment. FIG. 4 is a cross-sectional view taken along A-A in FIG. 3.

The bottle 1 shown in these Figures is a bottle made of plastic, which is formed by biaxially stretch blow-molding a preform made of a thermoplastic resin, and has a mouth portion 2, a shoulder portion 3, a body portion 4 and a bottom portion 5.

The height direction as used in the following explanation refers to the direction along the direction at right angles with a horizontal surface when the bottle 1 is placed on the horizontal surface with the mouth portion 2 up.

Preferably, the body portion 4 of the bottle 1 in this embodiment has the transverse-sectional form of an approximate rectangle, and the minor side thereof is 110 mm long or less. With this size, even a large container having a volume of 2,000 to 3,000 ml can be securely put in a refrigerator, and at the same time the bottle 1 is graspable with one hand.

The body portion 4 may have the transverse-sectional form of an approximate square. In this case, the excellent storability thereof in a refrigerator and its handling property can be secured so long as one side thereof is limited to 110 mm or less.

Nearly in the center in the height direction of the body portion 4, there is formed a waist portion 6 that is constricted along the circumferential direction.

The waist portion 6 is a portion having both the reinforcing member function to impart the body portion 4 with necessary strength and the grasping member function to make handling easy as a finger stop when the bottle 1 is grasped with one hand, and it has a waist groove 61 and a grasping recess 63.

The above waist groove 61 refers to a concave-shaped groove formed along the circumferential direction of the body portion 4, and is formed on the body portion 4 in this embodiment. When the bottle 1 is a rectangular type, the waist portion 61 may be formed on at least one pair of opposing surfaces of the body portion 4 nearly in the center along the height direction thereof.

Further, the waist grooves 61 positioned on the container front and container backside which are larger-length sides are each provided with a grasping recess 63 that is a dent for grasping. Each grasping recess 63 is formed in the center of lateral widths of the waist grooves 61 positioned in the container front and the container backside, and they improve the bottle 1 in graspability by letting the finger in when the bottle 1 is grasped with the fingers.

The waist groove 61 in this embodiment has a perpendicular groove bottom surface 61*a*, a container mouth portion side connecting face 61*b* that is positioned on the container upper side to the groove bottom surface 61*a* and connects the body portion 4 and the groove bottom surface 61*a*, and a container bottom portion side connecting face 61*c* that is positioned on the container lower side to the groove bottom surface 61*a* and connects the body portion 4 and the groove bottom surface 61*a*. In this embodiment, the container mouth portion side connecting face 61*b* of the waist groove 61 and the container bottom portion side connecting face 61*c* of the waist groove 61 have the longitudinal sectional form of a curved surface.

The grasping recess 63 has a perpendicular grasping recess bottom surface 63*a*, a container mouth portion side connecting face 63*b* that is positioned on the container upper side to the grasping recess bottom surface 63*a* and connects the body portion 4 or the container mouth portion side connecting face 61*b* of the waist groove 61 with the grasping recess bottom surface 63*a*, and a container bottom portion side connecting face 63*c* that is positioned on the container lower side to the grasping recess bottom surface 63*a* and connects the body portion 4 or the container bottom portion side connecting face 61*c* of the waist groove 61 with the grasping recess bottom surface 63*a*.

A finger receiving recess 62 is formed in a region including the container bottom portion side connecting face 61*c* of the waist groove 61 as shown in Figures, for suppressing a decrease in the stiffness and restoring capability of the container bottom portion side connecting face 61*c* of the waist groove 61 which decrease is entailed with a decrease in the wall thickness of the bottle 1.

Further, the finger receiving recess 62 in this embodiment is provided in a region that further includes the container bottom portion side connecting face 63*c* of the grasping recess 63.

In other words, as shown in FIG. 3(*b*), the finger receiving recess 62 is formed on the container bottom portion side of the container bottom portion side connecting face 63*c* positioned on the container bottom portion side of the grasping recess 63, such that it has a form obtained by chipping off the container bottom portion side connecting face 63*c* of the grasping recess 63 and the container bottom portion side connecting face 61*c* of the waist groove 61 at the same time with a portion shown by a dotted line in Figures.

In addition, there may be employed a constitution in which the region where the finger receiving recess 62 is formed is not included in the container bottom portion side connecting face 63*c* of the grasping recess 63. Further, there may be employed a constitution in which the finger receiving recess 62 is provided on the container front side alone and no such finger receiving recess is provided on the container backside.

The thus-constituted grasping recess 63 and finger receiving recess 62 in this embodiment are so close to each other that the index finger or middle finger that is let in the grasping recess 63 and the middle finger or medicinal finger that is let in the finger receiving recess 62 come in contact with each other when the bottle 1 is grasped. A grasping force can be hence easily applied thereto.

Further, in the example shown in Figures, the finger receiving recess 62 has a convex shape toward the inside of the container, its longitudinal section has a height h of 15 mm and an R70 circular arc form, and it has a width w of 35 mm. The finger receiving recess 62 preferably has a height h of 10 mm to 30 mm, and the longitudinal section of the center in the width direction of the finger receiving recess 62 is preferably of a curved surface having R20 mm to R120 mm circular arc form. The width w of the finger receiving recess 62 is preferably 20 mm to 50 mm.

When the above constitution is employed, not only the effect is fully exhibited, but the finger receiving recess 62 well receives and is fit to the finger while the strength of the curved surface of the finger receiving recess 62 is secured.

While the lower edge of the finger receiving recess 62 shown in Figures is formed in the form of a straight line, it may be curved so as to be convex toward the lower side of the container as required.

In this embodiment, further, the container bottom portion side connecting face 63*c* of the grasping recess 63 is formed of an upper connecting face 63*d* and a lower connecting face 63*e*.

In this constitution, not only the effect is fully exhibited, but the container bottom portion side connecting face 63*c* of the grasping recess 63 can be reinforced by an increase in the number of edge lines of the container bottom portion side connecting face 63*c* of the grasping recess 63.

When the container bottom portion side connecting face 63*c* of the grasping recess 63 is formed of two surfaces that are the upper connecting face 63*d* and lower connecting face 63*e*, preferably, the lower connecting face 63*e* connected directly to the finger receiving recess 62 is formed of an arch-like surface in the form of a band along the upper edge of the finger receiving recess 62 as shown in Figures.

In this manner, two edge lines are formed along the upper edge of the finger receiving recess 62 so as to be close to each other, so that the effect of reinforcing the container bottom portion side connecting face 63*c* of the grasping recess 63 can be further enhanced. Due to this, the deformation and buckling of the container bottom portion side connecting face 63 of the grasping recess 63 can be effectively avoided, and further, the finger fitting condition is improved, so that the bottle 1 is more improved in graspability.

When the lower connecting face 63*e* is formed of an arch-like surface in the form of a band along the upper edge of the finger receiving recess 62 like this embodiment, preferably, the tilt angle θ of the lower connecting face 63*e* to the horizontal surface is 30 to 65°. Further, while the width (a length between edges appearing on the surface of the bottle 1) L of the lower connecting face 63*e* may be nearly constant along the longitudinal direction, the width L may be narrowed toward the center for securing the area of the finger receiving recess 62. Although differing depending upon dimensions of the bottle 1, the specific value of the width L of the lower connecting face 63*e* is preferably, for example, approximately 2 to 5 mm.

Further, in this embodiment, preferably, the longitudinal section of the upper connecting face 63*d* connected directly to the bottom surface 63*a* of the grasping recess 63 preferably has the form of a convex curved surface toward an outside of the container.

Due to this, the stiffness and restoring capability of the upper connecting face 63*d* per se can be enhanced against a pressing force that is exerted on the upper connecting face 63*d* by the index finger or middle finger that is let in the grasping recess 63, and the deformation and buckling of the container bottom portion side connecting face 63*c* of the grasping recess 63 can be more effectively avoided.

Further, for further improving the stiffness and restoring capability of the upper connecting face 63*d* per se while the touch feeling when the bottle 1 is grasped is improved, preferably, the transverse section of the upper connecting face 63*d* at least in the center along the width direction has a convex form toward an inside of the container, and the total form of the upper connecting face 63*d* is pommel horse-like shape protruding inwardly of the container.

In this embodiment, a plurality of projections 90 having a flat circular form each are formed on the bottom surface 63*a* of the grasping recess 63 as an anti-slip member as shown in Figures, and such projections having a flat circular form each are preferred since they exhibit a multidirectional anti-slip effect.

In this embodiment, further, side beads 71 and 72 are formed one above the grasping recess 63 and one below the grasping recess 63 as shown in Figures. By this constitution, the side beads 71 and 72 provided above and below the grasping recess interrupt transmission of a pressing force that is exerted on the grasping recess 63 when the bottle 1 is grasped by letting the finger in the grasping recess 63, so that the denting and deformation of surface of the body portion 4 can be effectively avoided.

In this case, the container of a rectangular type like this embodiment has edge lines 80 formed along the height direction near corner portions, so that the strength against a longitudinal load is secured. When the side beads 71 and 72 are formed above and below the grasping recess 63, therefore, it is preferred to employ a constitution in which the side beads 71 and 72 do not cross over the above edge lines 80. On the other hand, when the ends of the side beads 71 and 72 are too far away from the above edge lines 80, the effect on the interruption of propagation of a pressing force exerted on the grasping recess 63 is impaired. The dimensions of the side beads 71 and 72 are determined by taking account of these. Specifically, it is preferred to determine the dimensions of the side beads 71 and 72 so that the distance L1 between the ends of the side beads 71 and 72 and the above edge lines 80 is 4 to 8 mm.

The bottle 1 is formed by biaxial stretch blow molding of a preform made of a thermoplastic resin as is already described. In this case, when the waist groove 61 or the grasping recess 63 is formed nearly in the center along the height direction like this embodiment, a resin is liable to build up in the central portion, and the body portion 4 tends to have a relatively smaller wall thickness on the sides of the mouth portion 2 and the bottom portion 5. Therefore, the body portion 4 on the mouth portion 2 and bottom portion 5 sides is liable to have problems such as a sink mark, etc., in portions having a relatively smaller wall thickness than other portions, and the appearance of the bottle 1 may be impaired.

In this embodiment, therefore, discontinuous steps 81*a* and 81*b* along the circumferential direction are formed on the mouth portion 2 side of the body portion 4, and a continuous step 82 along the circumferential direction is formed on the bottom portion 5 side of the body portion 4. This constitution prevents the sink mark in portions that are liable to have a smaller wall thickness on the sides of the mouth portion 2 and the bottom portion 5 of the body portion 4. In the example shown in Figures, when the steps 81*a* and 81*b* are not formed on the mouth portion 2 side of the body portion 4, sink marks are liable to occur in portions indicated by arrows Y in FIG. 2. Further, when the step 82 is not formed on the bottom portion 5 side of the body portion 4, sink marks are liable to occur in portions indicated by arrows X in FIGS. 1 and 2.

While the above embodiment has explained the invention with reference to the container of a rectangular type, it is needless to say that the present invention can be also applied to a container of a round type. In the case of the container of an angular type, the waist groove 61 of the waist portion 6 and the grasping recesses 63 are formed on at least one pair of opposing surfaces, and the finger receiving recess 62 is formed in one place in a region including the container bottom portion side connecting face 61*c* of the waist groove 61, whereby the bottle 1 can be grasped, and there can be exhibited effects on the finger receiving property, stiffness and restoring capability of the finger receiving recess. It is preferred to provide the waist groove 61 on a larger area of the body portion, since the container 1 is improved in stiffness. In this case, it is also sufficient to provide the grasping recesses 63 on at least one pair of opposing surfaces, and it is also sufficient to provide the finger receiving recess 62 in at least one place.

In this embodiment, as a thermoplastic resin for constituting the bottle 1, any thermoplastic resin can be used so long as it is a resin that is stretch blow-moldable and thermally crystallizable.

Specifically, the thermoplastic resin preferably includes thermoplastic polyesters such as polyethylene terephthalate, polybutylene terephthalate, polyethylene naphthalate, polycarbonate, polyarylate, polylactate or copolymers of these, and blends of these resins with other resins. In particular, ethylene terephthalate thermoplastic polyesters such as polyethylene terephthalate are suitably used.

Further, an acrylonitrile resin, polypropylene, a propylene-ethylene copolymer, polyethylene, or the like may be used.

These resins may contain various additives such as a colorant, an ultraviolet absorbent, a mold release agent, a lubricant, a nucleating agent, an antioxidant, an antistatic agent, etc., so long as they do not impair the quality of a molded product.

The ethylene terephthalate thermoplastic polyester for constituting the bottle 1 refers to a polyester whose ethylene terephthalate units cover a most part, generally at least 70%, of ester recurring units, and it preferably has a glass transition point (Tg) in the range of 50 to 90° C. and a melting point (Tm) in the range of 200 to 275° C.

As an ethylene terephthalate thermoplastic polyester, a polyethylene terephthalate (PET) is particularly excellent in pressure resistance, heat resistance and resistance against heat and pressure, while there may be used a copolyester containing a small amount of ester units derived from a dibasic acid such as isophthalic acid, naphthalenedicarboxylic acid, etc., and a diol such as propylene glycol, etc., in addition to the ethylene terephthalate unit.

Further, in addition to a case where the bottle 1 of this embodiment is constituted of a single layer (one layer) of a thermoplastic polyester, the bottle 1 may be constituted of two or more layers of a thermoplastic polyester.

Further, the bottle 1 of this embodiment may have an intermediate layer interposed between the inner and outer layers that are at least two layers of a thermoplastic polyester, and the intermediate layer may be a barrier layer or an oxygen-absorbing layer. When the above barrier layer or oxygen-absorbing layer is provided, the transmission of oxygen into the bottle 1 from an outside can be suppressed, and the alteration that oxygen from an outside causes on a content in the bottle 1 can be prevented.

As the above oxygen-absorbing layer, any layer can be used so long as it absorbs oxygen to prevent the transmission of oxygen. It is preferred to use a combination of an oxidizable organic component and a transition metal catalyst, or a combination of a gas-barrier resin that is substantially not oxidizable, an oxidizable organic component and a transition metal catalyst.

While the invention has been explained hereinabove with reference to the preferred embodiment, the invention shall not be limited to the embodiment alone, and it is needless to say that the invention can be modified in various ways in the scope of the invention.

For example, the container can be shaped in the form of a cup. Further, the container shall not be limited to ones made of plastic, and the invention can be also applied to a container made of a metal material such as aluminum or a material composed of paper as a main component.

Further, the transverse sectional form of the container shall not be limited to the form of an approximate rectangle or an approximate circle, and the container may be an angular type container having a transverse sectional form of an approximate square, an approximate hexagon or an approximate octagon which has an even number of sides, or a round type container having a transverse sectional form of an approximate ellipsoid.

INDUSTRIAL UTILITY

The invention is applied to a container having a waist groove nearly in the center in the height direction of the body portion and is particularly suitable for a thin-wall plastic bottle that is decreased in weight.

The invention claimed is:

1. A packaging container, comprising:

a mouth portion, a body portion and a bottom portion, a waist groove having a container mouth portion side connecting face, a groove bottom surface and a container bottom portion side connecting face, said waist groove being formed nearly in a center in a height direction of said body portion, at least one pair of mutually opposing grasping recesses formed on said waist groove, and at least one finger receiving recess formed in a region including at least the container bottom portion side connecting face of said waist groove, the at least one finger receiving recess being positioned on a side of said bottom portion relative to said waist groove and having a form of a convex curved surface toward an inside of the container.

2. A packaging container, comprising:

a mouth portion, a body portion and a bottom portion, a waist groove having a container mouth portion side connecting face, a groove bottom surface and a container bottom portion side connecting face, said waist groove being formed nearly in a center in a height direction of said body portion, at least one pair of mutually opposing grasping recesses formed on said waist groove, and at least one finger receiving recess formed in a region including at least the container bottom portion side connecting face of said waist groove, the at least one finger receiving recess being positioned on a side of said bottom portion relative to said waist groove and having a form of a convex curved surface toward an inside of the container, wherein said grasping recess has a container mouth portion side connecting face and a container bottom portion side connecting face which are respectively connected to a bottom surface of said grasping recess, and said finger receiving recess is formed in a region including the container bottom portion side connecting face of said grasping recess.

3. The packaging container of claim 2, wherein the container bottom portion side connecting face of said grasping recess is constituted of two or more surfaces that are joined together in the height direction.

4. The packaging container of claim 3, wherein the surface connected to said finger receiving recess out of the two or more surfaces constituting the container bottom portion side connecting face of said grasping recess is an arch-like surface in the form of a band along an upper edge of said finger receiving recess.

5. The packaging container of claim 4, wherein said arch-like surface has a tilt angle of 30 to 65° to a horizontal surface.

6. The packaging container of claim 4, wherein the surface connected to the bottom surface of said grasping recess out of the two or more surfaces constituting the container bottom portion side connecting faces of said grasping recess has a convex curved surface protruding toward an outside of the container.

7. The packaging container of claim 6, wherein the surface connected to the bottom surface of said grasping recess has a pommel horse-like form extending toward an inside of the container in a horizontal direction.

8. The packaging container of claim 2, wherein said finger receiving recess has a height of 5 mm to 30 mm and said finger receiving recess has a longitudinal sectional form of an arch-like curved surface in a center in a width direction.

9. The packaging container of claim 8, wherein said finger receiving recess has a lateral width of 20 mm to 50 mm.

10. The packaging container of claim 2, wherein a side bead is provided at least in one place above or below said grasping recess.

11. The packaging container of claim 2, wherein discontinuous or continuous steps along a circumferential direction are formed on said body portion on the said mouth portion side or said body portion on said bottom portion side which has relatively a smaller wall thickness than other portion.

12. A packaging container of an angular type, comprising:

a mouth portion, a body portion and a bottom portion, waist grooves each having a container mouth portion side connecting face, a groove bottom surface and a container bottom portion side connecting face, said waist grooves being formed nearly in a center in a height direction of at least one pair of mutually opposing surfaces of said body portion, at least one pair of mutually opposing grasping recesses formed on said waist grooves, and at least one finger receiving recess formed in a region including at least the container bottom portion side connecting face of said waist groove, the finger receiving recess being positioned on a side of said bottom portion relative to said waist groove and having a form of a convex curved surface toward an inside of the container.

13. The packaging container of claim 12, wherein said grasping recess has a container mouth portion side connecting face and a container bottom portion side connecting face which are respectively connected to a bottom surface of said grasping recess, and said finger receiving recess is formed in a region including the container bottom portion side connecting face of said grasping recess.

* * * * *